US006655012B2

(12) United States Patent
Katoda

(10) Patent No.: US 6,655,012 B2
(45) Date of Patent: Dec. 2, 2003

(54) FABRICATION METHOD OF SURGE PROTECTOR DEVICE AND THE DEVICE FABRICATED BY THE METHOD

(76) Inventor: Takashi Katoda, 4804-83, Ikku, Kochi-shi (JP), 780-8130

( * ) Notice: Subject to any disclaimer, the term of this patent is extended or adjusted under 35 U.S.C. 154(b) by 0 days.

(21) Appl. No.: 09/882,047

(22) Filed: Jun. 18, 2001

(65) Prior Publication Data

US 2001/0053056 A1 Dec. 20, 2001

(30) Foreign Application Priority Data

Jun. 20, 2000 (JP) ..... 2000-184471

(51) Int. Cl.[7] ..... H01H 69/02

(52) U.S. Cl. ..... 29/623; 29/825; 200/266; 200/267; 361/121; 361/124; 439/620; 439/131

(58) Field of Search ..... 29/623, 825; 439/620, 439/131; 200/266, 267; 361/121, 124, 119, 118

(56) References Cited

U.S. PATENT DOCUMENTS 4,029,380 A * 6/1977 Yonkers ..... 439/95
5,365,660 A * 11/1994 Capper et al. ..... 29/884
5,574,610 A * 11/1996 Tachick et al. ..... 361/56
6,118,664 A * 9/2000 Daoud ..... 361/728
6,424,514 B1 * 7/2002 Boy et al. ..... 361/119

* cited by examiner

*Primary Examiner*—Joseph J. Hail, III
*Assistant Examiner*—Alvin J Grant
(74) *Attorney, Agent, or Firm*—Eric J. Robinson; Robinson Intellectual Property Law Office, P.C.

(57) ABSTRACT

In the fabrication of a surge protector device which utilizes breakdown phenomena of a resistive film, a case which fixes metal bars in it, makes electrical contacts with the metal bars and contains oxidizing and refractory agents, a cap, metal bars and oxidizing and refractory agents are prepared in advance. In the fabrication process of the surge protector device using these elements, a step to control the force applied to the cap, the metal bars and the case so that the force applied to the interface between the resistive films and the mechanical contacts which form electrodes to the metal bars can be controlled. Automation process to fabricate the surge protector device will be realized and efficient fabrication of the precise surge protector device will be also realized. A surge protector device whose breakdown voltage is precisely controlled will be realized reproducibly.

30 Claims, 8 Drawing Sheets

FABRICATION METHOD OF SURGE PROTECTOR DEVICE AND THE DEVICE FABRICATED BY THE METHOD

BACKGROUND OF THE INVENTION

1. Field of the Invention

The present invention relates to method to fabricate a protector device and the device fabricated by the method.

2. Related Background Art

A protector device including a lightning discharger plays a very important role in protecting various electronic devices from surge including lightning. A protector device is a general name of devices which are used in order to protect other electronic devices from excess voltage, that is surge. An arrester is used to protect other electronic devices from lightning, that is extremely high voltage and large current. An arrester is one of the protector devices. The term of a protector device is used here to indicate devices which are used in order to protect other electronic devices from excess voltage. However, excess voltage is not limited to extremely high voltage but also includes a low voltage exceeding a specified voltage.

A glass tube type arrester has been used. It contains special gas between two electrodes in a glass tube. It is non-conductive unless surge is induced. When surge or lightning is induced, discharge starts and the gas between the electrodes changes to conductive. Current flows through the arrester and is led to the earth. Discharge does not stop immediately after surge is removed. The arrester cannot protect other electronic devices from continuous current or a next attack by surge or lightning. There are serious problems which a glass-tube and other type protector devices have. One of them is that a protector device must change from its resistive state to a conductive state in a very short time such as 0.03 $\mu$sec. when it is attacked by surge. Another problem is that a protector device should return from its conductive state to its resistive state when surge is removed.

In order to overcome the problems an arrester was proposed (Japanese Patent 118361, 1995 "Molybdenum arrester" by Seita Ohmori). It used plural molybdenum bars whose surface was oxidized. The arrester will be referred to as a "molybdenum arrester."

The molybdenum arrester leads current to the earth in a very short time when surge or lightning is induced. That is, it changes from non-conductive state to conductive state very quickly by breakdown of the oxide formed on the molybdenum bar. Moreover, it returns from conductive state to non-conductive state when surge or lightning is removed because molybdenum is oxidized quickly if it is in oxidizing atmosphere. The molybdenum arrester is very useful and economically efficient because it repeats change of the state automatically.

It is possible to use other metals than molybdenum in a protector device which functions with the same principle as the molybdenum arrester. Tantalium, chromium and aluminum are included in such metals. The principle of the molybdenum arrester can be applied also to a device in which single bar is used.

Although the molybdenum arrester has superior properties than other type arresters, it has been difficult to fabricate by an automation process. The reason was that delicate control was necessary during the fabrication. That is, it was necessary to control force applied to the interface between resistive films in the molybdenum arrester because a breakdown voltage at the interface depends on the force. In addition, electrical resistance at the interface between the molybdenum bars having a resistive film on it and the conductive part of the case or cap depends also on the force applied to the interface. The interface was used as an electrical contact between the molybdenum bar and the case or the cap. The reason why mechanical contact between the molybdenum bar and the case or the cap was used as an electrical contact was that it is possible that an electrical contact formed by alloying melts by heat produced by large current induced by surge. Electrical resistance of the contact decreases with increase of applied force. However, larger force does not give the optimum breakdown voltage at the interface between the resistive films. It was necessary, therefore, to control during fabrication force applied between the top of the cap and the bottom of the case in which the molybdenum bars are included. Control of the force by machine has been difficult.

SUMMARY OF THE INVENTION

The present invention is directed to useful methods to fabricate surge protector devices including arresters. The methods of the present invention make it possible to fabricate surge protector devices by automation process. In particular, in the fabrication process according to the present invention, the forces applied to the interface between the cap and the case and the metal bars, and the interface between the resistive films are controlled automatically.

In the method of the present invention, a case in which metal bars are fixed and oxidizing and refractory agents are put in, a cap, metal bars with a resistive film on the surface, oxidizing and refractory agents are prepared in advance. At least a part of the bottom of the case and at least a part of the top of the cap are made conductive and form electrical contacts to the metal bars.

The case and the cap can be joined to form a single body which can be sealed at the late stage of the process.

The fabrication process according to the present invention includes following steps.

At the first step, the case is fixed on the holding table. The bottom of the cap has a shape adapted to fix the metal bar.

At the next step, the metal bars are inserted into the case such that at least a part of the lowest metal bar contacts with the inner side of the conductive part of the bottom of the case. Plural metal bars are piled up upwards.

At the next step, the oxidizing and the refractory agents are put in the case. The case is then vibrated in order to stabilize the oxidation and the refractory agents. The metal bars are fixed to the case during the step to give vibration in order not to change relative position between the bar and the case. The oxidizing and the refractory agents are added if necessary and vibration is given again. The steps are repeated until a predetermined amount of the oxidizing and the refractory agents are put in the case. The oxidizing and the refractory agents are put in such that all metal bars except the uppermost metal bar are buried in the agents.

At the next step, the cap is put on the case such that at least a part of the inner side of the conductive part of the cap contacts at least a part of the uppermost part of the uppermost metal bar.

At the next step, a predetermined force is applied between the cap and the case, and they are fixed to a single body keeping the force.

At the next step, the body is sealed.

In another embodiment, the fourth step can be done by other methods. For example, in third embodiment divided covers are put on the case such that there is no gap between the vacuum gripper and the covers as shown in FIG. 15. At least one of the divided covers has an inlet port through which the oxidizing and the refractory agents can be inserted. The oxidizing and the refractory agents are inserted with pressurized air into the case while the covers are pressed so that they are not lifted. The vacuum gripper holds the metal bar tightly.

Further in other embodiment, it is possible to put an inner cap on the case while the vacuum gripper holds the metal bar. An inner cap fixes a part of the metal bar. After the inner cap in fixed, the vacuum gripper is removed from the metal bar. Then an outer cap is put on the inner cap and pressed with a predetermined force followed by fixing.

DETAILED DESCRIPTION OF THE PREFERRED EMBODIMENT

Reference will now be made in greater detail to preferred embodiments of the invention, examples of which are illustrated in the accompanying drawings.

In an example of the embodiment, the metal bar consists of molybdenum. The surface of the molybdenum bar is oxidized in advance. Methods of pretreatment and oxidation of molybdenum are described in the Japanese Patent Applications No. 2000-93106 and A case, a cap of the case, molybdenum bars, and oxidizing and refractory agents (which are to be enclosed in the case) are prepared in advance.

Figure 1:
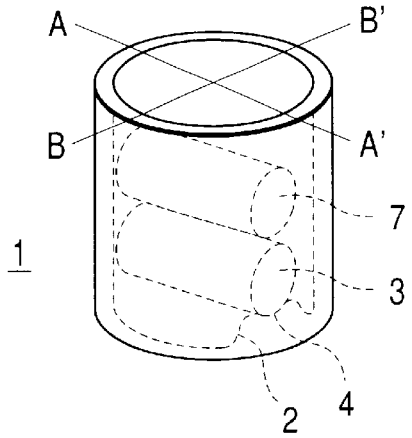
FIG. 1 illustrates the case and the main elements put in said case of the surge protector device according to one embodiment of the present invention.

As shown in FIG. 1, the case (1) is cylindrical in the embodiment. The bottom (2) of the case (1) has a shape which is adequate to fix the lowermost molybdenum bar (3) and has a conductive part which forms an electrical contact (4) with the lowermost molybdenum bar (3). One of the desirable shapes of the bottom (2) is a part of cylinder which contacts about one third of the molybdenum bar when the bar is cylindrical. Broken lines in FIG. 1 represent schematically the molybdenum bars (3, 7) in the case (1) and the shape of the bottom (2) of the case (1).

Figure 2:
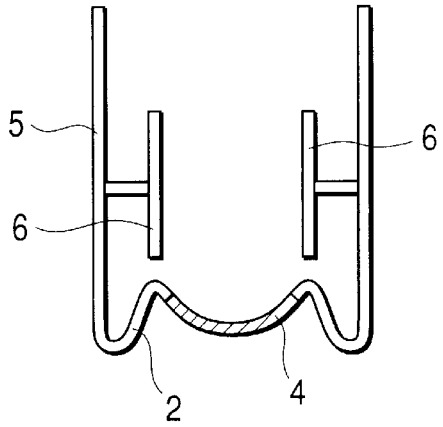
FIG. 2 is a cross sectional view along the line A–A' in FIG. 1.
Figure 3:
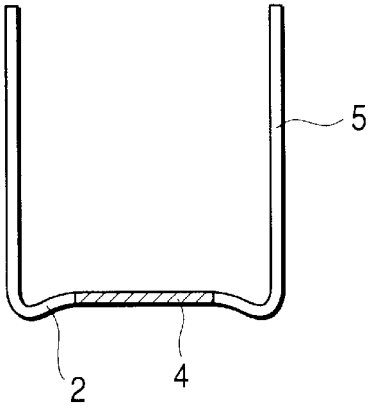
FIG. 3 is a cross sectional view along the line B–B' in FIG. 1.

FIGS. 2 and 3 show cross sectional drawings along the lines A–A' and B–B' in FIG. 1, respectively. The case (1) is formed of refractory material such as ceramic except the bottom (2) at least a part of which is conductive. The top of the case is open in order to insert the cap at the late step.

Bar holders (6) are formed in the case (1) such that they stick the molybdenum bars in order to fix them. It is advantageous that the bar holder (6) consists of posts more than four, that is more than two on each side of the molybdenum bars. It is desirable that the bar holder (6) consists of posts which project from the bottom (2) of the case (1) vertically or are supported by arms projected from the body (5) of the case (1) when the molybdenum bars are piled up horizontally. A desirable length of the bar holder (6) is from the bottom or near the bottom to about a half of the diameter of the uppermost molybdenum bar. It is advantageous that the bar holder (6) does not contact with the cap (8) when it is inserted at the late step of the fabrication process. The bar holder (6) is made of material which is electrically resistive and refractory.

Figure 4:
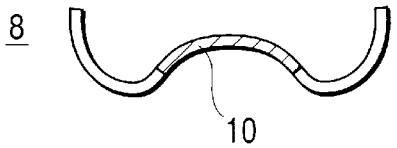
FIG. 4 illustrates the cap of the surge protector device according to one embodiment of the present invention.

The cap (8) has an outer diameter which is as nearly the same as possible with the inner diameter of the case (1) in order that the case (1) and the cap (8) are joined to form a sealed case. FIG. 4 shows schematically the cap (8). At least a part of the bottom (10) of the cap (8) is formed of conductive material to make electrical contact to the uppermost molybdenum bar (7) and has a shape such as concave trench in order to fix the molybdenum bar (7). Depth of the trench is about one-third of the diameter of the molybdenum bar. The cap (8) can move vertically and push the molybdenum bar when force is applied in the fabrication process.

It is desirable that the oxidizing and the refractory agents are mixed in a predetermined ratio in advance. The desirable ratio is described in the Japanese Patent Application No. 2000-93108.

After preparation of the elements, the surge protector device is fabricated following to the steps 1 to 7 or 8 as shown below.

Figure 5:
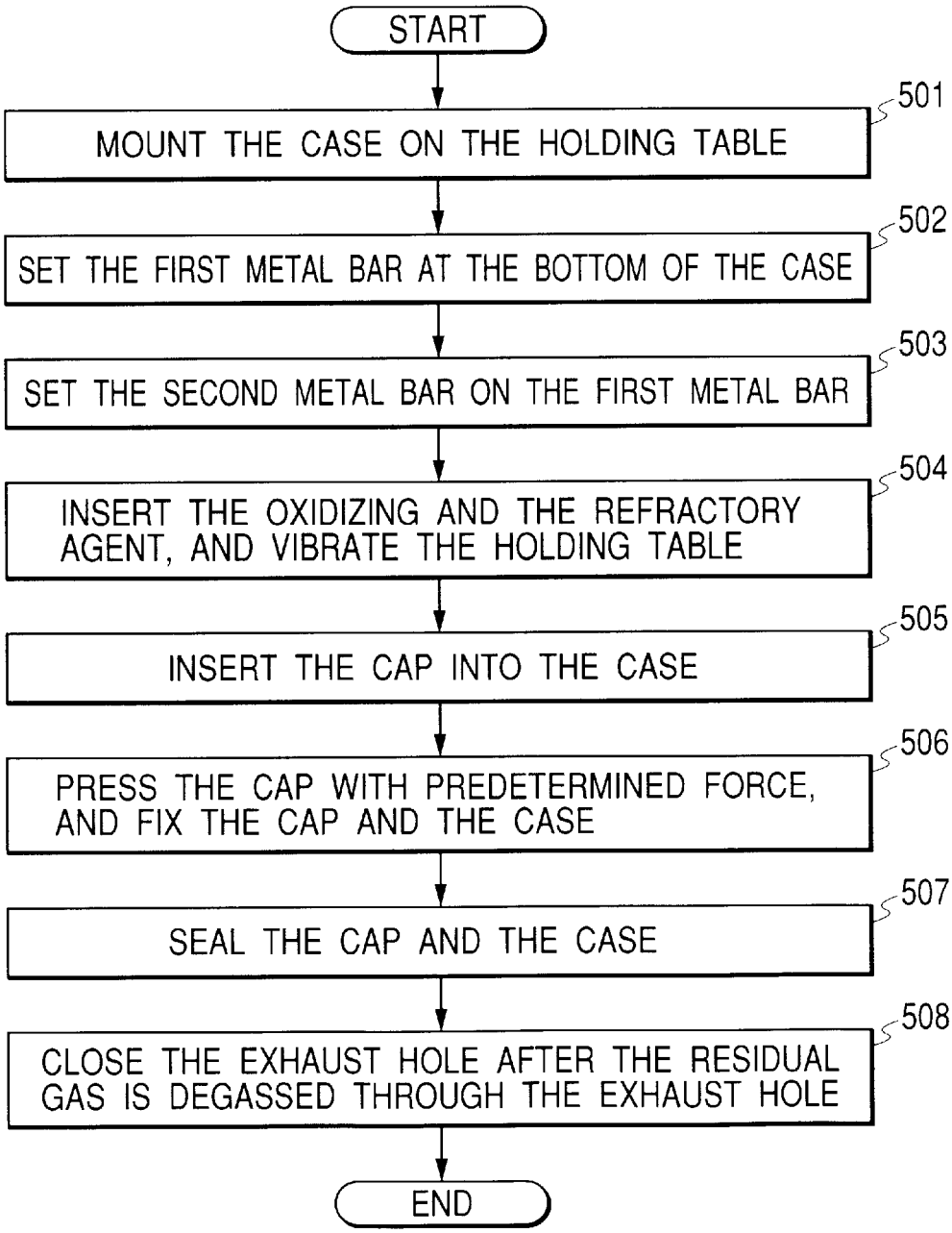
FIG. 5 illustrates a flow diagram of the fabrication process according to a method of the present invention.

An outline of the process including the step 1 to 8 is shown in FIG. 5.

Figure 6:
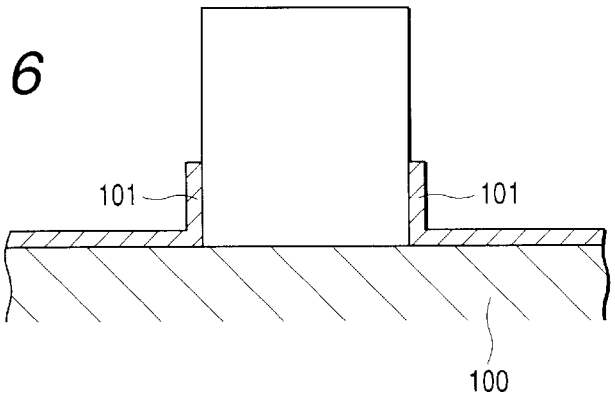
FIGS. 6, 7, 8, 9, 10, 11, 12 and 13 illustrate schematically the surge protector device at each step of the method according to one embodiment of the present invention.

At the first step (501), the case (1) is mounted on the holding table (100). The case (1) is fixed by a fixing element (101) which can move horizontally on the main surface of the holding table (100). The fixing element (101) and methods to fix are well known to those skilled in the art. FIG. 6 shows the case (1) fixed on the holding table (100).

Figure 7:
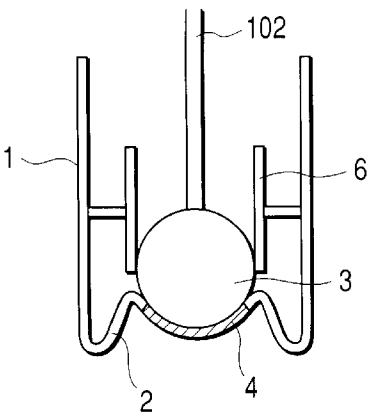
Figure 8:
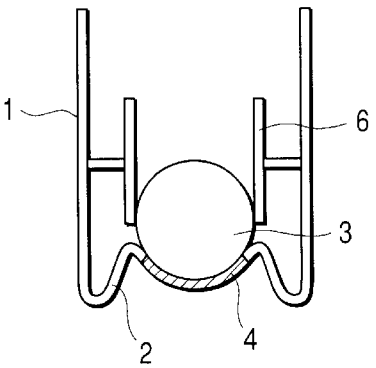

At the second step (502), the metal bar (3) which is to be set at the lowermost position is held up by, for example, the first vacuum gripper (102) and inserted into the case (1). FIG. 7 shows schematically this step. After the metal bar (3) is set at the bottom of the case (1) the first vacuum gripper (102) is removed from the metal bar (3). FIG. 8 shows this situation.

Figure 9:
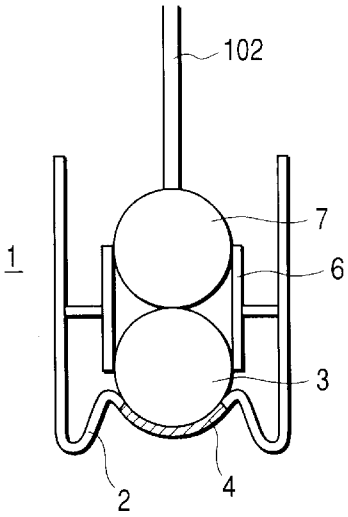

At the third step (503), predetermined number of metal bars are set in the case (1) in the same manner as the second step (502). The first vacuum gripper (102) keeps holding the uppermost metal bar after it is set. FIG. 9 shows the structure of the surge protector device at this stage of the fabrication in which two metal bars are used. The metal bar inserted in the case (1) at the third step is indicated by the reference number (7).

At the fourth step (504), the oxidizing and the refractory agents are inserted into the case (1) and then the holding table (100) is vibrated vertically in order to stabilize the oxidizing and the refractory agents (9). After the holding table is vibrated, the oxidizing and the refractory agents are added if necessary and the holding table (100) is vibrated again. This step is repeated until the oxidizing and the refractory agents (9) fill the case (1) from its bottom to about three quarter in the direction of a diameter of the uppermost metal bar (7). It is important that the lower electrode (4) at the bottom (2) of the case and the metal bar (3), and the metal bars (3, 7) are kept contact each other.

Figure 10:
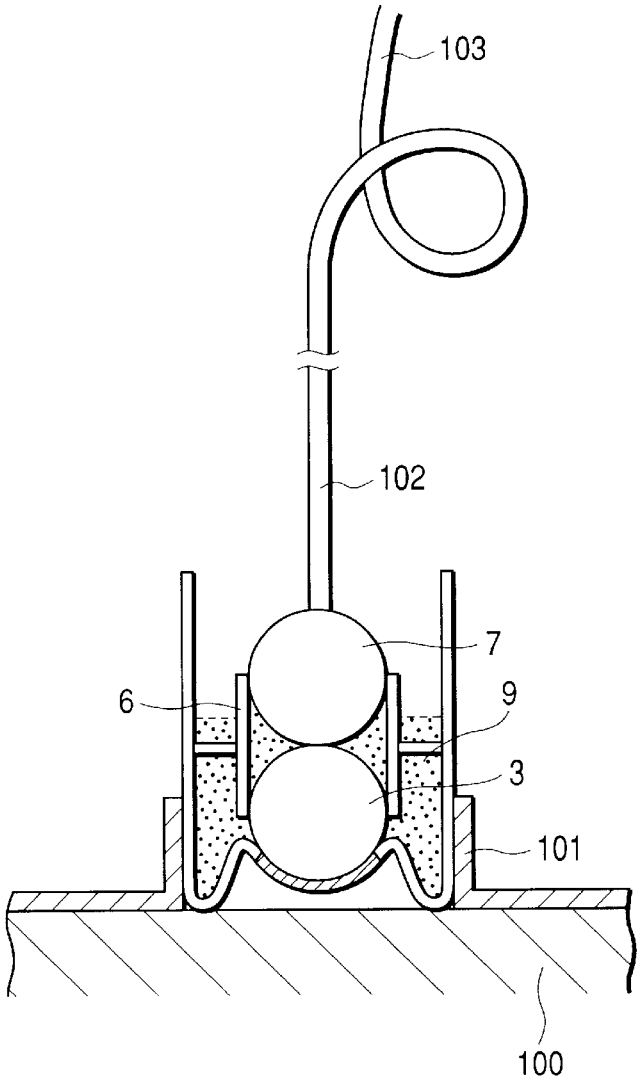
Figure 11:
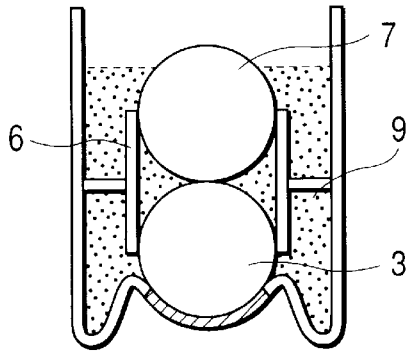

During the fourth step (504), the uppermost metal bar (7) is kept being held by the first vacuum gripper (102). It is necessary, therefore, the first gripper (102) has a flexible part (103) in order to follow vibration of the holding table. FIG. 10 shows schematically the fourth step (504). After completion of the fourth step (504), the first vacuum gripper (102) is removed from the metal bar (7). FIG. 11 shows the structure of the surge protector device after the first vacuum gripper (102) is removed from the metal bar.

Figure 12:
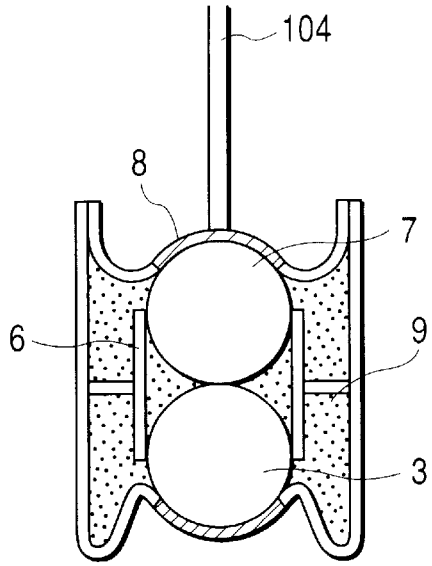
Figure 13:
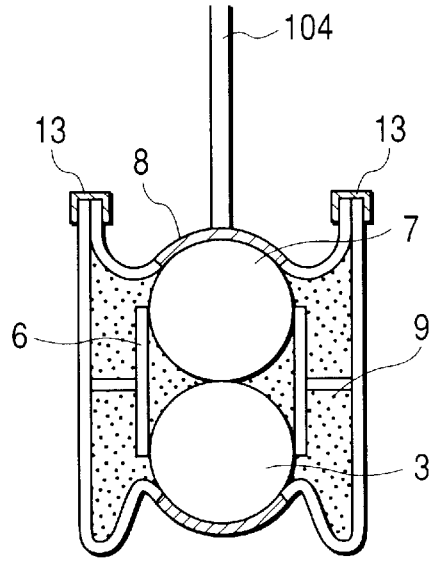

At the fifth step (505), the cap (8) is held up by the second vacuum gripper (104) and inserted into the case (1) in a direction such that the metal bars (3, 7) are fixed. The second vacuum gripper (104) keeps holding the cap (8). FIG. 12 shows this situation.

At the sixth step (506), force is applied to the second vacuum gripper (104) downwards to press the cap with predetermined force. A source of force and monitor equipment such as a pressure meter (not shown in the Figures) are connected at the upper end portion of the second vacuum gripper (104). The cap (8) and the case (1) are fixed at their upper ends by well known means such as settling metals (13). While force is being applied, the second vacuum gripper (104) must be stiff such that force is applied through the second vacuum gripper (104). In addition, the upper electrode (10) which is a part of the cap (8) must contact with the uppermost metal bar (7). The second vacuum gripper (104) is removed after the cap and the case are fixed.

At the seventh step (507), the upper ends of the cap (8) and the case (1) are sealed by well known method. Although in the above description, fixing step of the upper ends of the cap and the case, and sealing step are separate steps, they can be done at the same time. When the oxidizing agent is not used, the sealing step is not necessary.

Figure 14:
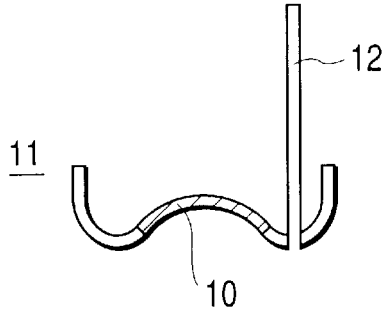
FIG. 14 illustrates schematically the cap of the surge protector device according to the second embodiment of the present invention.

In the second embodiment, a cap (11) has an exhaust port (12) in order to exhaust residual air at the eighth step (508) in the case as shown in FIG. 14. In that case, the exhaust port (12) is sealed after exhausting residual air in the case (1) from the exhaust port (12) following to sealing step of the upper ends of the cap (11) and the case (1).

Uniformity of properties and reliability of the fabricated surge protector device increase significantly by adding the eighth step (508) described above.

In an embodiment, the metal bar was a cylindrical molybdenum bar with a diameter of 6 mm and a length of 6 mm, and the inner diameter of the case (1) was 12 mm and the height was 18 mm. The metal bars (3, 7) were formed by oxidation of the molybdenum bars at 700° C. for 13 min. in oxygen atmosphere without water. The oxidizing agent (e.g., potassium chlorate) having a weight of 1.5 g and the refractory agent having a weight of 5 g were mixed prior to the start of the fabrication process. The fabricated surge protector device had a breakdown voltage of 700 V.

It is possible that the surge protector device fabricated according to the present invention has a breakdown voltage in a wider range and it can be used in general to protect various electronic devices from surge as well as lightning.

The embodiment described above was only to show an example and various alternations and changes can be made by those skilled in the art without departing from the spirit and scope of the invention.

For example, a shape of the cap (1) and the metal bars (3, 7) is not limited to cylinder.

Furthermore, it is possible to electrically connect the case and the lowermost metal bar or the cap and the uppermost metal bar by any methods such as alloying or welding of metal.

In the fourth step, it is not necessary to add the oxidizing and the refractory agents if they are put in sufficiently by the first insertion. In addition, the fourth step, that is insertion of the oxidizing and the refractory agents is not necessary if the resistive film on the surface of the metal bar revives quickly after break by surge. It is not necessary to vibrate the holding table in the fourth step to stabilize the oxidizing and the refractory agents if they are put in by blow.

Figure 15:
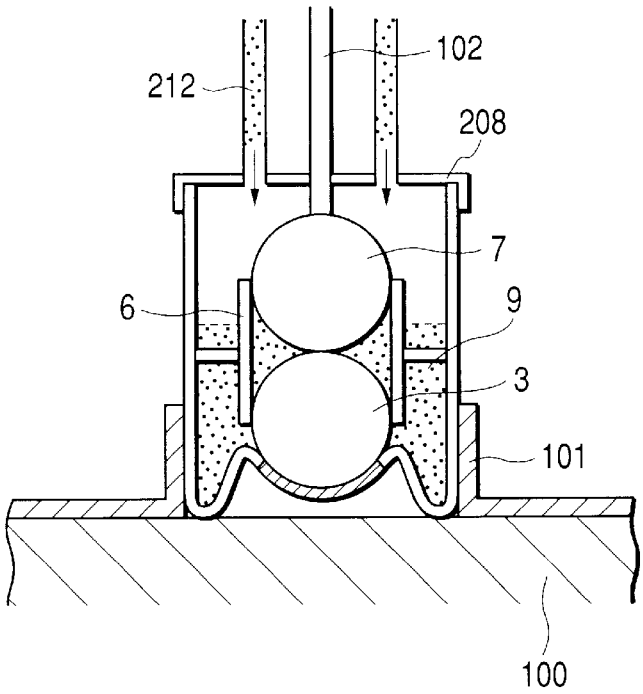
FIG. 15 illustrates schematically the cover and the case which are used to insert the oxidizing and the refractory agents and to stabilize them according to the third embodiment of the present invention.

The fourth step (504) can be done by other methods. For example, in third embodiment divided covers (208) are put on the case (1) such that there is no gap between the vacuum gripper (102) and the covers (208) as shown in FIG. 15. At least one of the divided covers (208) has an inlet port (212) through which the oxidizing and the refractory agents (9) can be inserted. The oxidizing and the refractory agents (9) are inserted with pressurized air into the case (1) while the covers (208) are pressed so that they are not lifted. The vacuum gripper (102) holds the metal bar (7) tightly. It is not necessary in this case, that the vacuum gripper (102) has a flexible part and to give vibration to the case (1).

In FIG. 15, the cover is shown to be divided into two parts. However, the cover (208) may be divided into more than two parts or it is not necessary to be divided. If it is not divided, it is necessary that the cover has an aperture through which the vacuum gripper (102) can be passed.

Figure 16:
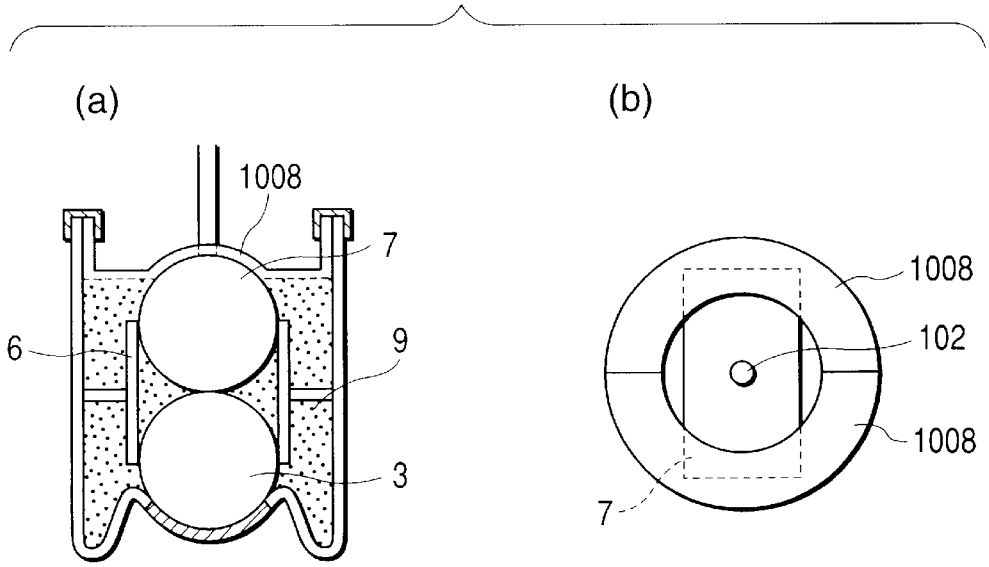
FIG. 16 illustrates an inner cap by a cross sectional view (FIG. 16(*a*)) and a top view (FIG. 16(*b*)) which is used to fix the metal bar while the vacuum gripper holds the metal bar according to the fourth embodiment of the present invention.

In the embodiment described above, the cap (8) is put on the case (1) after the vacuum gripper (102) was removed from the metal bar (7) following to insertion and stabilization of the oxidizing and the refractory agents (9) as shown in FIGS. 11 and 12. It is possible, however, to put an inner cap (1008) on the case (1) while the vacuum gripper (102) holds the metal bar (7). In the fourth embodiment, an inner cap (1008) fixes a part of the metal bar (7) as shown in FIG. 16. FIG. 16(*a*) shows a cross sectional view of the case (1) and the inner cap (1008) and FIG. 16(*b*) shows a top view of the inner cap (1008), the vacuum gripper (102) and the metal bar (7). A part of the metal bar (7) presented by broken lines is fixed by the inner cap (1008). The inner cap (1008) is pressed also with a predetermined force by an appropriate mean (not shown in the Figure) and fixed. The inner cap (1008) may be divided or may not be divided.

Figure 17:
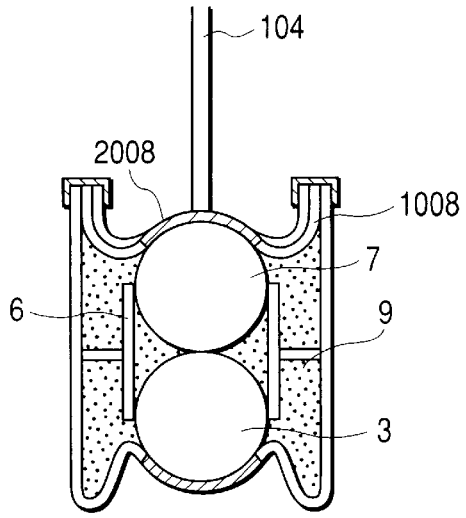
FIG. 17 illustrates schematically the surge protector device at the step in which an outer cap is put on the uppermost metal bar and fixed to the case while being pressed with a predetermined force according to the fourth embodiment of the present invention.

After the inner cap (1008) is fixed and the vacuum gripper (102) is removed from the metal bar (7), an outer cap (2008) is put on the inner cap (1008) as shown in FIG. 17. The outer cap (2008) has a conductive part which contacts a part of the metal bar (7) which is not under the inner the cap (1008) and is exposed. The conductive part forms an electrode to the metal bar (7). The outer cap (2008) is pressed with a predetermined force and fixed. After the outer cap (2008) is fixed, the case (1) and the outer cap (2008) are sealed as described above.

A diameter of the case is not limited to a specified value as long as the metal bars can be set horizontally. It is desirable, however, that the metal bar and the inner surface of the case except the conductive part which makes an electrode don't contact because no current should flow along the surface. In addition, the bottoms of the case and the cap are not necessary curved surface as shown in FIG. 2 but both have a flat surface as long as the metal bars (3, 7) are fixed tightly by the metal bar holders (6).

Furthermore, although the metal bars were piled horizontally in the embodiment described above, they can be set vertically if the case and the cap are modified and electrical contacts are formed. As is known to those skilled in the art, it is possible to modify, add or eliminate the step(s) in the fabrication process or the materials depending on required reliability of the surge protector device or adaptability of the fabrication process.

Figure 18:
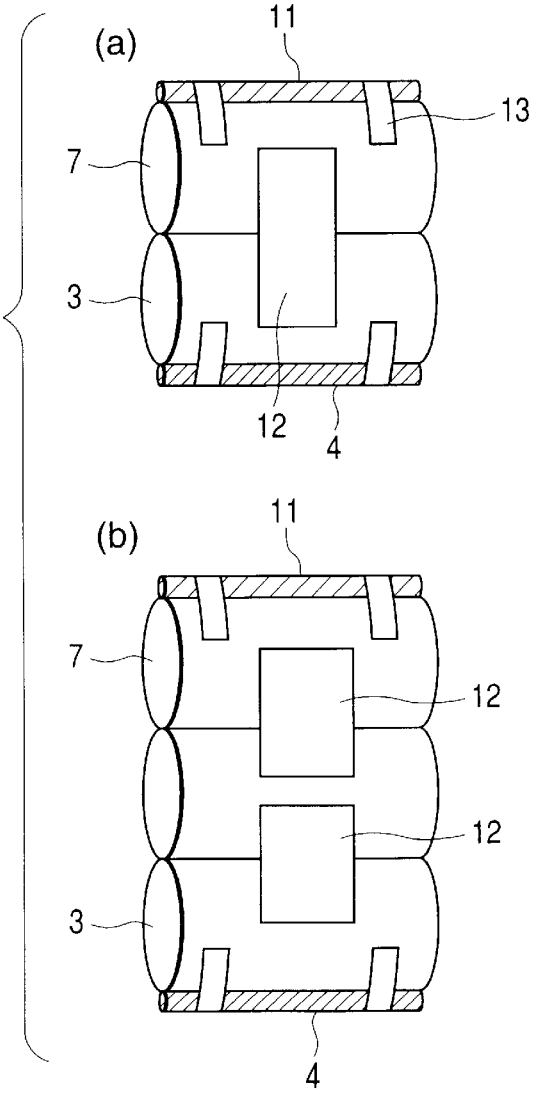
FIG. 18 illustrate schematically the main elements of the surge protector device according to the fifth embodiment of the present invention.

In the fifth embodiment, the metal bars are formed as shown in FIG. 18(*a*). At first, the first metal bar (3) and the second metal bar (7) both of which have resistive films on their surfaces are prepared and then they are fixed by a holding arm (12) such that they are pressed by predetermined force. It is necessary that no current flows along the holding arm (12). The metal bars may be fixed by a well known method mechanically or chemically such as with paste. It is possible to modify the breakdown voltage by insert an additional metal bar(s) between the first and the second metal bars as shown in FIG. 18(*b*).

At the next step, electrical contacts are formed on the surface of the metal bar or the resistive film by welding of contact material or crimping. If crimping is used, the contact material and the metal bar are fixed by the second holding arm (13) at a predetermined force. Although two electrodes were formed in the fifth embodiment, it is possible to form more than two electrodes depending on particular applications. Furthermore formation of the electrodes can be done prior to crimping of the metal bars. The first and the second holding arms may be formed of the same material.

The metal bars formed as described above are set in the case (1) and electrical connection from outside of the case is formed. After then, the case is filled with the oxidizing and the refractory agents. It is possible to make an exhausting port in the case and exhaust air including water in the case.

Figure 19:
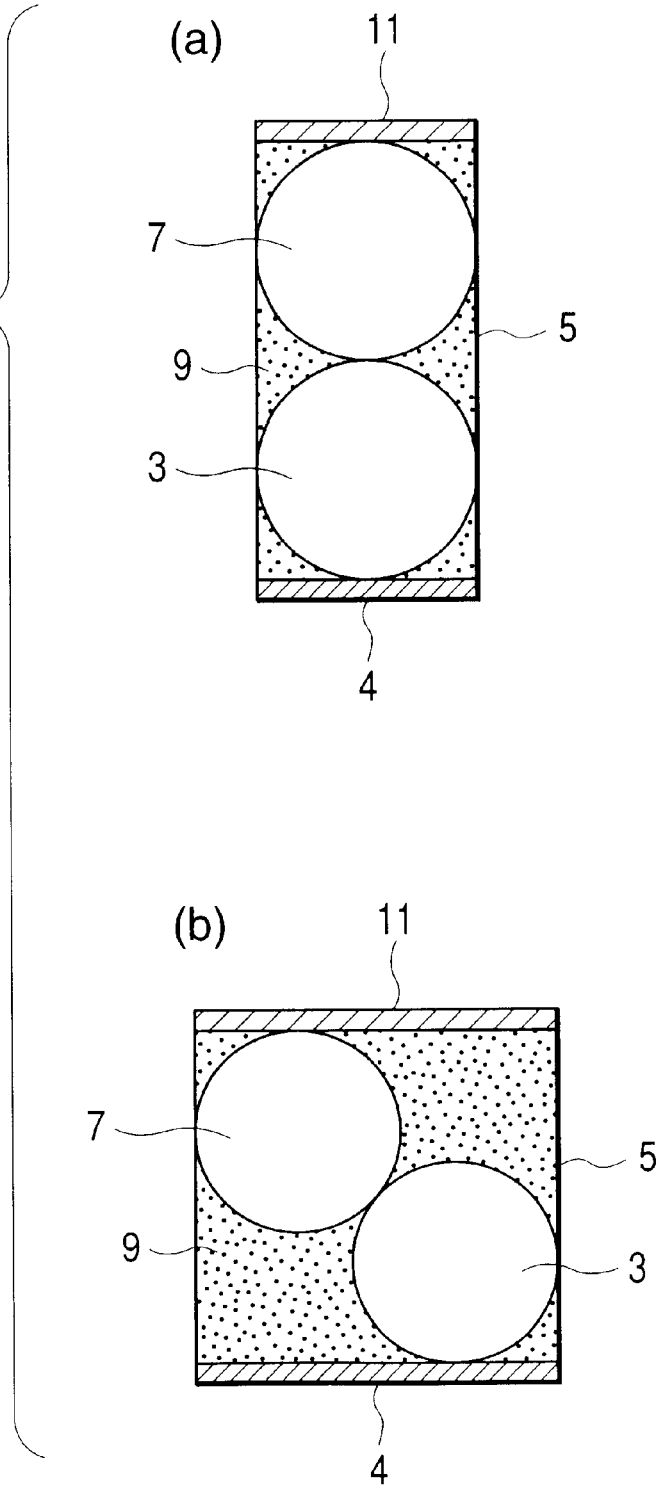
FIG. 19 illustrate the body which includes electrodes and is used as holding means of the surge protector device according to the sixth embodiment of the present invention.

As easily thought by those skilled in the art, a part of the case can be used to give force to the metal bars (3, 7) or to both the metal bars and the electrodes (4, 11) as shown in FIG. 19. It is possible also to form the electrodes (4, 11) in a part of the case (1).

According to the present invention, it is possible to control quantitatively and precisely the force applied to the interface between the resistive films or the electrodes and the metal bars. Therefore, it can be realized that the surge protector devices are fabricated by automation process. In addition, the surge protector devices with a predetermined breakdown voltage can be fabricated reproducibly using an automation system including a robot with a high efficiency.

What is claimed is:

1. A method for fabricating a surge protector device said method comprising the steps of:

preparing in advance a plurality of metal bars each coated with a resistive film, a case whose bottom is at least partially conductive which can house said metal bars and has a shape adapted to fix said metal bars, and a cap whose bottom is at least partially conductive which has a shape adapted to fix said metal bars and to seal the case;

mounting said case on a holding table;

piling up said plurality of metal bars in order to form the inner surface of said bottom of said case;

putting said cap on an uppermost metal bar in said case;

giving a predetermined force to said cap such that said bottom of said cap, said plurality of metal bars and said bottom of said case are pressed by the predetermined force to fix said cap to said case; and sealing hermetically an enclosure formed by said cap and said case so that the inside of said enclosure is isolated from the outside.

2. The method as recited in claim 1, further comprising the step of putting a mixture of oxidizing and refractory agents in said case after the step of piling up said metal bars, giving vibration to said case while holding said metal bars in order to stabilize said mixture of oxidizing and refractory agents, adding if necessary said mixture of oxidizing and refractory agents until said mixture fills said case to a height such that all said metal bars except said uppermost metal bar and a part of said uppermost metal bar are buried in said mixture.

3. A method for fabricating a surge protector device, said method comprising:

a first step to prepare in advance a plurality of metal bars each coated with a resistive film, a case whose bottom is at least partially conductive which can house said metal bars and has a shape adapted to fix said metal bars, metal bar holders supporting said metal bars from the side thereof, a mixture of oxidizing and refracting agents at a predetermined ratio, and a cap whose bottom is at least partially conductive which has a shape adapted to fix said metal bars and an outer wall adapted to be put in said case close to the inner wall thereof, a second step to mount said case on a holding table;

a third step to lift the first metal bar by some means such as a vacuum gripper, set it on the bottom of said case and to take off said vacuum gripper;

a fourth step to lift the second metal bar by some means such as a vacuum gripper and set on said first metal bar while said vacuum gripper keeps holding said second metal bar;

a fifth step to put said oxidizing and refractory agents in said case, to give vibration to said holding table in order to stabilize said oxidizing and refractory agents while said vacuum gripper keeps holding said metal bar, to add said oxidizing and refractory agents if necessary and to give vibration again to said holding table, to repeat these steps until said oxidizing and refractory agents fill said case to a height such that all said metal bars except an uppermost metal bar and about three quarters in the direction of a diameter of said uppermost metal bar are buried in said oxidizing and refractory agents and to take off said vacuum gripper from said uppermost metal bar;

a sixth step to lift said cap by some means such as a vacuum gripper and insert it into said case such that the bottom of said cap fixes said metal bar while said vacuum gripper keeps holding said cap;

a seventh step to give force to said cap through said vacuum gripper such that said cap, said plural metal bars and said case are pressed by a predetermined force, to fix said cap and said case to each other by some means such as clasps and to take off said vacuum gripper from said cap; and an eighth step to hermetically seal an enclosure formed by said cap and said case.

4. The method as recited in claim 3 further comprising a ninth step to seal said enclosure formed by said cap and said case such that air in said enclosure is exhausted.

5. A method as recited in claim 3 or 4 wherein more than two said metal bars are piled up in said fourth step and said fifth step starts while said vacuum gripper keeps holding said uppermost metal bar.

6. A method for fabricating a surge protector device, said method comprising:

a first step to prepare in advance a plurality of metal bars each coated with a resistive film, a case whose bottom is at least partially conductive which can house said metal bars and has a shape adapted to fix said metal bars, metal bar holders supporting said metal bars from the side thereof, a mixture of oxidizing and refracting agents at a predetermined ratio, and a cap whose bottom is at least partially conductive which has a shape adapted to fix said metal bars and an outer wall adapted to be put in said case close to the inner wall thereof, a second step to mount said case on a holding table;

a third step to lift the first metal bar by some means such as a vacuum gripper, set it on the bottom of said case and to take off said vacuum gripper;

a fourth step to lift the second metal bar by some means such as a vacuum gripper and set on said first metal bar while said vacuum gripper keeps holding said second metal bar;

a fifth step to put a cover having an aperture through which the vacuum gripper can be passed and an inlet port through which the oxidizing and refractory agents can be inserted on the case and to insert the oxidizing and refractory agents by blowing them with pressurized air while the cover is pressed in order not to be lifted until all said metal bars except an uppermost metal bar and about three quarters in the direction of a diameter of said uppermost metal bar are buried in said oxidizing and refractory agents and to take off said vacuum gripper from said uppermost metal bar;

a sixth step to lift said cap by some means such as a vacuum gripper and insert it into said case such that the bottom of said cap fixes said metal bar while said vacuum gripper keeps holding said cap;

a seventh step to give force to said cap through said vacuum gripper such that said cap, said plural metal bars and said case are pressed by a predetermined force, to fix said cap and said case to each other by some means such as clasps and to take off said vacuum gripper from said cap; and an eighth step to hermetically seal an enclosure formed by said cap and said case.

7. The method as recited in claim 6 further comprising a ninth step to seal said enclosure formed by said cap and said case such that air in said enclosure is exhausted.

8. A method as recited in claim 6 or 7 wherein more than two said metal bars are piled up in said fourth step and said fifth step starts while said vacuum gripper keeps holding said uppermost metal bar.

9. A method for fabricating a surge protector device, said method comprising:

a first step to prepare in advance a plurality of metal bars each coated with a resistive film, a case whose bottom is at least partially conductive which can house said metal bars and has a shape adapted to fix said metal bars, metal bar holders supporting said metal bars from the side thereof, a mixture of oxidizing and refracting agents at a predetermined ratio, and a cap whose bottom is at least partially conductive which has a shape adapted to fix said metal bars and an outer wall adapted to be put in said case close to the inner wall thereof, a second step to mount said case on a holding table;

a third step to lift the first metal bar by some means such as a vacuum gripper, set it on the bottom of said case and to take off said vacuum gripper;

a fourth step to lift the second metal bar by some means such as a vacuum gripper and set on said first metal bar while said vacuum gripper keeps holding said second metal bar;

a fifth step to put said oxidizing and refractory agents in said case, to give vibration to said holding table in order to stabilize said oxidizing and refractory agents while said vacuum gripper keeps holding said metal bar, to add said oxidizing and refractory agents if necessary and to give vibration again to said holding table, to repeat these steps until said oxidizing and refractory agents fill said case to a height such that all said metal bars except an uppermost metal bar and about three quarters in the direction of a diameter of said uppermost metal bar are buried in said oxidizing and refractory agents;

a sixth step to put an inner cap on said uppermost metal bar such that said inner cap fixes a part of said metal bar while said vacuum gripper holds said uppermost metal bar, to give a predetermined force to said inner cap, to fix said inner cap and said case and to take off said vacuum gripper from said uppermost metal bar;

a seventh step to put an outer cap on said uppermost metal bar such that the conductive part of said outer cap contacts said uppermost metal bar and forms an electrode with it;

an eighth step to give a predetermined force to said outer cap and to fix said outer cap and said case by some means such as clasps; and a ninth step to hermetically seal an enclosure formed by said outer cap and said case.

10. The method as recited in claim 9 further comprising a tenth step to seal said enclosure formed by said cap and said case such that air in said enclosure is exhausted.

11. A method as recited in claim 9 or 10 wherein more than two said metal bars are piled up in said fourth step and said fifth step starts while said vacuum gripper keeps holding said uppermost metal bar.

12. A surge protector device formed by a method said method comprising the steps of:

preparing in advance a plurality of metal bars each coated with a resistive film, a case whose bottom is at least partially conductive which can house said metal bars and has a shape adapted to fix said metal bars, and a cap whose bottom is at least partially conductive which has a shape adapted to fix said metal bars and to seal the case;

mounting said case on a holding table;

piling up said plurality of metal bars in order to form the inner surface of said bottom of said case;

setting said cap on the surface of an uppermost metal bar piled in said case;

giving a predetermined force to said cap such that said bottom of said cap, said plurality of metal bars and said bottom of said case are pressed by the predetermined force to fix said cap to said case; and sealing hermetically an enclosure formed by said cap and said case so that the inside of said enclosure is isolated from the outside.

13. A surge protector device as recited in claim 12 formed by a method further comprising the step of putting a mixture of oxidizing and refractory agents in said case after the step of piling up said metal bars, giving vibration to said case while holding said metal bars in order to stabilize said mixture of oxidizing and refractory agents, adding if necessary said mixture of oxidizing and refractory agents until said mixture fills said case to a height such that all said metal bars except a part of said uppermost metal bar are buried in said mixture.

14. A surge protector device formed by a method, said method comprising:

a first step to prepare in advance a plurality of metal bars each coated with a resistive film, a case whose bottom is at least partially conductive which can house said metal bars and has a shape adapted to fix said metal bars, metal bar holders supporting said metal bars from the side thereof, a mixture of oxidizing and refracting agents at a predetermined ratio, and a cap whose bottom is at least partially conductive which has a shape adapted to fix said metal bars and an outer wall adapted to be put in said case close to the inner wall thereof, a second step to mount said case on a holding table;

a third step to lift the first metal bar by some means such as a vacuum gripper, set it on the bottom of said case and to take off said vacuum gripper;

a fourth step to lift the second metal bar by some means such as a vacuum gripper and set on said first metal bar while said vacuum gripper keeps holding said second metal bar;

a fifth step to put said oxidizing and refractory agents in said case, to give vibration to said holding table in order to stabilize said oxidizing and refractory agents while said vacuum gripper keeps holding said metal bars, to add said oxidizing and refractory agents if necessary and to give vibration again to said holding table, to repeat these steps until said oxidizing and refractory agents fill said case to a height such that all said metal bars except an uppermost metal bar and about three quarters in the direction of a diameter of said uppermost metal bar are buried in said oxidizing and refractory agents and to take off said vacuum gripper from said uppermost metal bar;

a sixth step to lift said cap by some means such as a vacuum gripper and insert it into said case such the bottom of said cap fixes said metal bar while said vacuum gripper keeps holding said cap;

a seventh step to give force to said cap through said vacuum gripper such that said cap, said plural metal bars and said case are pressed by a predetermined force, to fix said cap and said case to each other by some means such as clasps and to take off said vacuum gripper from said cap; and an eighth step to hermetically seal an enclosure formed by said cap and said case.

15. A surge protector device as recited in claim 14 formed by a method further comprising a ninth step to seal said enclosure formed by said cap and said case such that air in said enclosure is exhausted.

16. A surge protector device as recited in claim 14 or 15 formed by a method in which more than three said metal bars are piled up in said fourth step and said fifth step starts while said vacuum gripper keeps holding said uppermost metal bar.

17. A surge protector device formed by a method, said method comprising:

a first step to prepare in advance a plurality of metal bars each coated with a resistive film, a case whose bottom is at least partially conductive which can house said metal bars and has a shape adapted to fix said metal bars, metal bar holders supporting said metal bars from the side thereof, a mixture of oxidizing and refracting agents at a predetermined ratio, and a cap whose bottom is at least partially conductive which has a shape adapted to fix said metal bars and an outer wall adapted to be put in said case close to the inner wall thereof, a second step to mount said case on a holding table;

a third step to lift the first metal bar by some means such as a vacuum gripper, set it on the bottom of said case and to take off said vacuum gripper;

a fourth step to lift the second metal bar by some means such as a vacuum gripper and set on said first metal bar while said vacuum gripper keeps holding said second metal bar;

a fifth step to put a cover having an aperture through which the vacuum gripper can be passed and an inlet port through which the oxidizing and refractory agents can be inserted into the case and to insert the oxidizing and refractory agents by blowing them with pressurized air while the cover is pressed in order not to be lifted until all said metal bars except an uppermost metal bar and about three quarters in the direction of a diameter of said uppermost metal bar are buried in said oxidizing and refractory agents and to take off said vacuum gripper from said uppermost metal bar;

a sixth step to lift said cap by some means such as a vacuum gripper and insert it into said case such that the bottom of said cap fixes said metal bar while said vacuum gripper keeps holding said cap;

a seventh step to give force to said cap through said vacuum gripper such that said cap, said plural metal bars and said case are pressed by a predetermined force, to fix said cap and said case to each other by some means such as clasps and to take off said vacuum gripper from said cap; and an eighth step to hermetically seal an enclosure formed by said cap and said case.

18. A surge protector device as recited in claim 17 formed by a method further comprising a ninth step to seal said enclosure formed by said cap and said case such that air in said enclosure is exhausted.

19. A surge protector device as recited in claim 17 or 18 formed by a method in which more than two said metal bars are piled up in said fourth step and said fifth step starts while said vacuum gripper keeps holding said uppermost metal bar.

20. A surge protector device formed by a method, said method comprising:

a first step to prepare in advance a plurality of metal bars each coated with a resistive film, a case whose bottom is at least partially conductive which can house said metal bars and has a shape adapted to fix said metal bars, metal bar holders supporting said metal bars from the side thereof, a mixture of oxidizing and refracting agents at a predetermined ratio, and a cap whose bottom is at least partially conductive which has a shape adapted to fix said metal bars and an outer wall adapted to be put in said case close to the inner wall thereof, a second step to mount said case on a holding table;

a third step to lift the first metal bar by some means such as a vacuum gripper, set it on the bottom of said case and to take off said vacuum gripper;

a fourth step to lift the second metal bar by some means such as a vacuum gripper and set on said first metal bar while said vacuum gripper keeps holding said second metal bar;

a fifth step to put said oxidizing and refractory agents in said case, to give vibration to said holding table in order to stabilize said oxidizing and refractory agents while said vacuum gripper keeps holding said metal bars, to add said oxidizing and refractory agents if necessary and to give vibration again to said holding table, to repeat these steps until said oxidizing and refractory agents fill said case to a height such that all said metal bars except an uppermost metal bar and about three quarters in the direction of a diameter of said uppermost metal bar are buried in said oxidizing and refractory agents;

a sixth step to put an inner cap on said uppermost metal bar such that said inner cap fixes a part of said metal bar while said vacuum gripper holds said uppermost metal bar, to give a predetermined force to said inner cap, to fix said inner cap and said case and to take off said vacuum gripper from said uppermost metal bar;

a seventh step to put an outer cap on said uppermost metal bar such that the conductive part of said outer cap contacts said uppermost metal bar and forms an electrode with it;

an eighth step to give a predetermined force to said outer cap and to fix said outer cap and said case by some means such as clasps; and a ninth step to hermetically seal an enclosure formed by said outer cap and said case.

21. A surge protector device as recited in claim 20 formed by a method further comprising the ninth step to seal said enclosure formed by said cap and said case such that air in said enclosure is exhausted.

22. A surge protector device as recited in claim 20 or 21 formed by a method in which more than three said metal bars are piled up in said fourth step and said fifth step starts while said vacuum gripper keeps holding said uppermost metal bar.

23. A surge protector device comprising first and second metal bars having a resistive film on their surface, first and second electrodes connected to said first and second metal bars, respectively, and resistive holding means, and said first and second metal bars are fixed such that at least a part of the surface of each metal bar is pressed by a first predetermined force to each other by said holding means.

24. A surge protector device comprising first and second metal bars having a resistive film on their surface, first and second electrodes connected to said first and second metal bars, respectively, and resistive holding means, and said first and second metal bars are fixed by said holding means such that at least a part of the surface of each metal bar is pressed by a first predetermined force to each other.

25. A surge protector device as recited in claim 23 or 24 wherein said first and second electrodes are formed by welding on said first and second metal bars, respectively.

26. A surge protector device as recited in claim 23 or 24 wherein said first and said second electrodes are connected such that they are pressed by a second holding means to said first and said second metal bars, respectively, with a second predetermined force.

27. A surge protector device as recited in claim 25, wherein said first and second metal bars and said first and second electrodes are put in a body such that said first and second electrodes can be electrically connected from the outside of said body, oxidizing and refractory agents fill the space in said body and said body is sealed.

28. A surge protector device as recited in claim 27 wherein said body is formed such that the environment in said body can be controlled through an exhaust port formed in said body.

29. A surge protector device as recited in claim 27 wherein said first and second electrodes are formed using a part of said body.

30. A surge protector device as recited in claim 27 wherein said body is used also as a means for holding said first and second forces.

* * * * *